United States Patent [19]

Cullen

[11] 3,993,084

[45] Nov. 23, 1976

[54] FINGERNAIL WRAPPER AND METHOD

[76] Inventor: Carol Cullen, 8445 Allenwood Road, Los Angeles, Calif. 90046

[22] Filed: Nov. 1, 1974

[21] Appl. No.: 519,808

[52] U.S. Cl. ..... 132/73
[51] Int. Cl.[2] ..... A45D 29/00
[58] Field of Search ..... 132/73, 88.5, 88.7

[56] References Cited

UNITED STATES PATENTS

| | | | |
|---|---|---|---|
| 2,031,225 | 2/1936 | O'Donnell | 132/88.5 |
| 2,239,040 | 4/1941 | Holmes | 132/88.5 |
| 2,288,386 | 6/1942 | Belden | 132/73 |
| 2,688,331 | 9/1954 | Bogoslowsky | 132/73 |
| 2,746,460 | 5/1956 | Jellinek | 132/73 |
| 2,864,384 | 12/1958 | Walter | 132/73 |
| 3,228,404 | 1/1966 | Turner | 132/73 |
| 3,245,418 | 4/1966 | Dinerstein | 132/88.5 |
| 3,478,756 | 11/1969 | Sautter et al. | 132/73 |

*Primary Examiner*—G.E. McNeill
*Attorney, Agent, or Firm*—Romney Schaap Golant Scillieri Disner & Ashen

[57] ABSTRACT

A fingernail wrapper and wrapping technique utilizing a thin flexible sheet, of tissue paper, for example, which includes a rear tab portion, a forwardly divergent intermediate portion forming a forward extension of the rear portion and having forwardly divergent edges, and a front portion forming a forward extension of the intermediate portion and including generally transverse rows of perforations along which the sheet may be torn to adjust the length of the front portion thereof. In applying the wrapper, the rear portion and the intermediate portion are adhered to the upper surface of the nail with the rear portion spaced from the cuticle enclosing the base of the nail, and with the forwardly divergent edges of the intermediate portion overlying the side edges of the nail substantially at the points where they begin to protrude forwardly from the finger itself, i.e., at the points where they begin to separate from the finger itself. The foregoing accomplished, the next step is to tear the front portion along a selected one of the rows of perforations such as to provide the front portion with a length to fit neatly under the tip of the nail. Then, the front portion of the sheet is tucked under the tip of the nail and is adhered to the under side of the nail adjacent its tip. Finally, after smoothing down the wrapper, one or more coats of nail polish, hardener, or mending polish, are applied to the top, under side and tip of the nail, any polish, or the like, being removed from the cuticle with an orange stick in the usual manner.

8 Claims, 11 Drawing Figures

FINGERNAIL WRAPPER AND METHOD

BACKGROUND OF INVENTION

The present invention relates in general to a fingernail wrapper and wrapping technique for repairing and/or reinforcing fingernails so that they may be grown to any desired length. After application of the wrapper to the nail, one or more coats of clear or colored polish, hardener and/or mender may be applied over the wrapper, any excess which may be inadvertently applied to the cuticle being removed with an orange stick as usual.

SUMMARY AND OBJECTS OF INVENTION

A general object of the present invention is to provide a fingernail wrapper and wrapping technique which constitute improvements over prior nail patches and patching techniques.

The invention may be summarized as comprising, and an important object of the invention is to provide a fingernail wrapper which includes: a rear, tab portion adhered to the upper surface of the nail adjacent its base and spaced from the cuticle enclosing the base of the nail; a forwardly divergent intermediate portion forming a forward extension of the rear portion and having forwardly divergent edges respectively overlying the side edges of the nail substantially at the points where they begin to protrude forwardly from the finger, such intermediate portion being adhered to the upper surface of the nail adjacent its tip; and a front portion forming a forward extension of the intermediate portion and tucked under the tip of the nail and adhered to the under side of the nail adjacent its tip.

The invention may be further summarized as comprising a fingernail wrapping method characterized by the use of a thin flexible sheet which includes a rear portion, a forwardly divergent intermediate portion forming a forward extension of the rear portion and having forwardly divergent edges, and a front portion forming a forward extension of the intermediate portion, the front portion including generally transverse rows of perforations along which the sheet may be torn to adjust the length of the portion thereof to fit under the nail adjacent its tip, the method including the steps of: adhering the rear portion and the intermediate portion of the sheet to the upper surface of the nail with the forwardly divergent edges of the intermediate portion overlying the side edges of the nail substantially at the points where they begin to protrude forwardly from the finger; tearing the front portion along a selected one of the rows of perforations such as to provide the front portion with a length to fit neatly under the tip of the nail; and tucking the front portion of the sheet under the tip of the nail and adhering it to the under side of the nail adjacent its tip.

By providing the front portion of the fingernail wrapper with generally transverse rows of perforations along which the sheet may be torn, the length of the front portion may be adjusted to a value such that it can be tucked neatly around the sides and under the tip of the protruding portion of the nail and adhered to the under side of the nail adjacent its tip, which is an important feature of the invention.

After the wrapper has been smoothed out on the upper side of the nail, one or more coats of clear polish, hardener and/or mending polish may be applied to the wrapper, both on the upper surface of the nail, and the under side of the forwardly protruding tip. Such base coat or coats are clear, and a final, colored coat may be added to give the desired final finish.

For a nail which is too short to have the wrapper tucked under the tip thereof, the tucking operation is omitted, and the front portion of the wrapper is filed off at the edge of the nail with downward strokes, the nail edge then being sealed with clear polish.

The fingernail wrapper of the invention, when applied as indicated above, reinforces the nail so that the nail can be grown to any desired length. As the nail grows, the wrapper of the invention may be removed periodically and replaced with a new one positioned in the same manner as hereinbefore described, and utilizing the same technique.

The foregoing objects, advantages, features and results of the present invention, together with various other objects, advantages, features and results thereof which will be evident to those skilled in the art to which the invention relates in the light of this disclosure, may be achieved with the exemplary embodiments of the invention illustrated in the accompanying drawing and described in detail hereinafter.

DETAILED DESCRIPTION OF INVENTION

Figure 1:
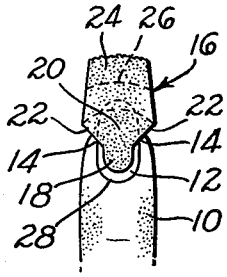
FIGS. 1, 2, 3, 4, 5, 6, 7 and 8 are views illustrating successive steps in the technique of the invention of applying a fingernail wrapper thereof to a fingernail.

Referring initially to FIG. 1 of the drawing, illustrated therein is a finger 10 having a nail 12 the side edges of which begin to protrude forwardly from the finger at points 14. These are the points where most nail breakage tends to begin.

Continuing to refer to FIG. 1, the initial step in the technique of the invention is to apply to the upper surface of the nail a coat of nail polish, or other adhesive, preferably clear. Then, a fingernail wrapper 16 of the invention is applied while the adhesive on the upper surface of the nail is still wet. The wrapper 16 comprises a rear, tab portion 18, a forwardly divergent intermediate portion 20 forming a forward extension of the rear portion and having forwardly divergent edges 22, and a front portion 24 forming a forward extension of the intermediate portion. The front portion includes generally transverse rows 26 of perforations along which the thin, flexible sheet constituting the wrapper may be torn to adjust the length of the front portion thereof to fit neatly under the nail adjacent its tip, as will be described hereinafter.

As shown in FIG. 1 of the drawing, the wrapper 16 is so positioned on the adhesive coated upper surface of the nail 12 that the rear portion 18 is located adjacent the base of the nail, but spaced from the cuticle 28 enclosing the base of the nail. The wrapper 16 is also so positioned that the forwardly divergent edges 22 of the intermediate portion 20 respectively overlie the side edges of the nail 12 substantially at the points 14 where such side edges begin to protrude forwardly from the finger.

Figure 2:
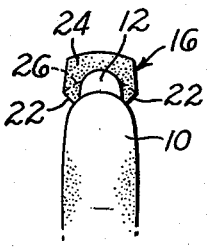
Figure 3:
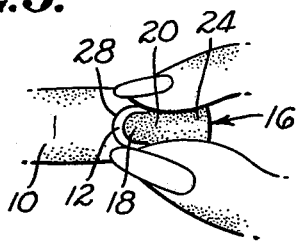

The front portion 24 of the wrapper 16 is torn along one of the perforation rows 26 so selected as to provide the front portion with a length such as to fit neatly under the tip of the nail, the front portion being shown torn off along an appropriate one of the perforation rows 26 in FIG. 2 of the drawing. One way of applying the wrapper 16 in the foregoing manner is to hold it in place with two fingers of the opposite hand until such time as the rear and intermediate portions 18 and 20 of the wrapper adhere to the upper surface of the nail firmly. This is shown in FIG. 3 of the drawing. It is not necessary to obtain a perfectly smooth adhesion between the upper surface of the nail 12 and the rear and intermediate portions 18 and 20 of the wrapper 16 at this stage, since any wrinkles, air bubbles, or the like, may be eliminated later, as will be described hereinafter.

Figure 4:
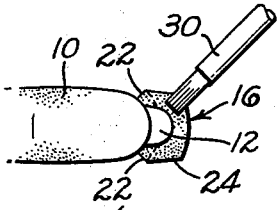

Next, as shown in FIG. 4, clear fingernail polish, or other adhesive, is applied to the under side of the nail and to the exposed portions of the under sides of the intermediate and front portions 20 and 24 of the wrapper 16, utilizing a brush 30, or the like.

Figure 5:
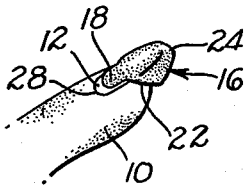

Then, as shown in FIG. 5, the wrapper 16 is folded around the side edges of the nail 12, as by using the tip of a finger of the opposite hand, or the tips of two fingers of the opposite hand, in the manner suggested in FIG. 3.

Figure 6:
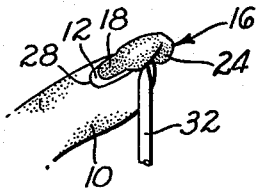

The foregoing accomplished, the sides of the wrapper 16 are tucked under the protruding tip of the nail 12, as by utilizing an orange stick 32, preferably dipped in polish remover. This procedure is shown in FIG. 6 of the drawing.

Figure 7:
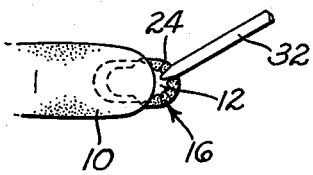

The next step, as shown in FIG. 7, is to fold the extreme tip of the wrapper 16 under the protruding tip of the nail 12. The tissue is folded over the tip of the nail with the fingertip first and then the orange stick 32, dipped in remover, is used to smooth the tissue down.

Figure 8:
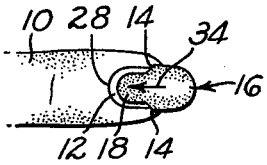

The upper surface of the wrapper 16 is then smoothed down, as by stroking it in the direction of the arrow 34, FIG. 8, utilizing the tip of a finger of the opposite hand, preferably moistened in polish remover. In doing this, it should be made certain that the edges of the wrapper 16 are securely sealed, again utilizing the tip of a finger of the opposite hand. To secure proper sealing, more clear polish is dabbed on the upper surface of the wrapper and is then smoothed down with the fingertip again.

The foregoing completes the installation of the wrapper 16. It is important to note that, by locating the forwardly divergent edges 22 of the wrapper 16 so that they overlie the side edges of the nail substantially at the points 14 where they begin to protrude forwardly from the finger, the nail 12 is thoroughly reinforced at the points where it is most likely to break, these being the points 14.

After the wrapper 16 has been installed in the foregoing manner, two or three coats of clear polish, hardener, mender, or the like, may be applied to the top, under side and tip of the wrapped nail. Any polish, or the like, inadvertently applied to the cuticle 28 may be removed with an orange stick in the usual manner. Finally, a color coat, in the desired color, may be applied to provide the desired finished appearance.

For a nail too short to have a portion of the wrapper 16 tucked under the protruding tip thereof, the same general technique may be utilized, except the excess wrapper is filed off at the tip of the nail, using downward strokes of an emery board. The resulting filed edge may then be sealed with clear polish.

If it is desired to remove the wrapper, this may be accomplished by soaking the finger tip in a small bowl of remover for a few minutes, an orange stick being utilized to loosen and remove the wrapper. Alternatively, a rubber glove may be placed on the opposite hand, and the removing accomplished by utilizing a cotton swab soaked in a suitable remover.

Figure 9:
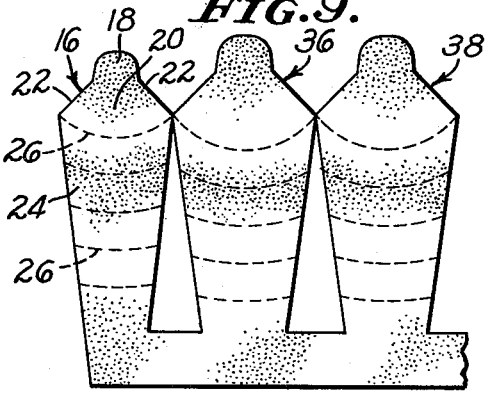
FIG. 9 is a view showing a supply of fingernail wrappers of the invention in different sizes to accommodate fingernails of different sizes.

FIG. 9 of the drawing shows a sheet of the desired wrapper material comprising one of the wrappers 16 and wrappers 36 and 38 all of different sizes for fingernails of different sizes.

Figure 10:
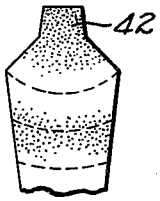
FIGS. 10 and 11 are views showing alternative embodiments of the invention.
Figure 11:
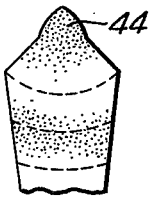

In FIGS. 1 to 9, the rear portion 18 of the wrapper 16 is shown as a rounded tab. This tab may have other shapes, as indicated by the tabs 42 and 44 in FIGS. 10 and 11, respectively.

Although exemplary embodiments of the invention have been disclosed herein for illustrative purposes, it will be understood that various minor changes, modifications and substitutions may be incorporated in such embodiments without departing from the invention as hereinafter claimed.

I claim as my invention:

1. A fingernail wrapper designed for remaining on a nail after a manicure is completed comprising a thin flexible sheet of tissue which includes:

a. a rear portion adherable to the upper surface of the nail adjacent its base and having opposite first side boundaries not extending over the skin next to the nail base;

b. forwardly divergent intermediate portion forming a forward extension of said rear portion and having second side boundaries flared out relative to said first side boundaries to overlap the side edges of the nail substantially at the points where they begin to protrude forwardly from the finger, said intermediate portion being adherable to the upper surface of the nail adjacent its tip and to the lower surface of the nail adjacent its side edges; and c. a front portion forming a forward extension of said intermediate portion and adherable to the lower surface of the nail adjacent its tip, whereby a tissue coating is provided for the upper and lower surfaces and terminal edge of the nail.

2. A fingernail wrapper according to claim 1 wherein said front portion includes one or more generally transverse rows of perforations along which said sheet may be torn to adjust the length of said front portion thereof to extend beyond the front edge of the nail for folding back to fit under the nail adjacent its tip.

3. A fingernail wrapper according to claim 1 wherein said rear portion comprises a tab of any suitable configuration and of a size to be spaced from the cuticle enclosing the base of the nail.

4. A wrapped fingernail having fixedly secured thereto a thin flexible liquid absorbent sheet which remains on the nail after a manicure is completed, said sheet comprising:

a. a rear portion adhered to the upper surface of the nail adjacent its base;

b. a forwardly divergent intermediate portion forming a forward extension of said rear portion and having forwardly divergent edges respectively overlying the side edges of the nail substantially at the points where they begin to protrude forwardly from the finger, said intermediate portion being adhered to the upper surface of the nail adjacent its tip; and c. a front portion forming a forward extension of said intermediate portion and tucked under the tip of the nail and adhered to the lower surface of the nail adjacent its tip by the application of liquid to provide a reinforced protective coating for the upper and lower surfaces and along the entire terminal edge of the nail without elongating the tip of the nail.

5. A wrapped fingernail as defined in claim 4 wherein said rear portion of said sheet comprises a tab of any suitable configuration and of a size such that it is spaced from the cuticle enclosing the base of the nail.

6. A fingernail wrapping method characterized by the use of a thin flexible absorbent sheet which includes a rear portion, a forwardly divergent intermediate portion forming a forward extension of the rear portion and having forwardly divergent edges relative to the adjacent rear portion, and a front portion forming a forward extension of the intermediate portion, said method including the steps of:

a. adhering by liquid the rear portion and the intermediate portion to the upper surface of the nail with the forwardly divergent edges of the intermediate portion overlying the side edges of the nail substantially at the points where they begin to protrude forwardly from the finger;

b. extending the front portion of the sheet beyond the tip of the nail;

c. filing the front portion of the sheet to terminate the front portion at the tip of the nail; and d. tucking said forwardly divergent edges of the intermediate portion around the side edges of the nail for adherence by liquid to the lower surface of the nail.

7. A fingernail wrapping method comprising the steps of:

a. cutting a thin flexible sheet of moisture-absorbent tissue to form a rearward tab and a forward portion with sides diverging forwardly from the tab;

b. providing one or more transverse perforations extending across the width of the forward portion;

c. adhering the tab to the nail adjacent the cuticle and the forward portion to the nail adjacent its tip extending beyond the forward and side edges of the nail;

d. tearing the forward portion along one of the transverse perforations;

e. tucking the remainder of the forward portion under the nail edges; and f. applying moisture to the tissue to flatten any folded or pleated tissue under the nail edges.

8. The method of claim 7 wherein the cutting step includes cutting the sheets in different widths, and, prior to said adhering step, further including the step of selecting a sheet with a width sufficiently narrow to avoid overlying any skin behind the point where the side edges of the nail extend forwardly past the cuticle.

* * * * *